US008220886B2

(12) United States Patent
Han et al.

(10) Patent No.: US 8,220,886 B2
(45) Date of Patent: Jul. 17, 2012

(54) REFRIGERATOR WITH AUXILIARY BASKET

(75) Inventors: Jae Myung Han, Gwangju (KR); Jae Hoon Lim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1114 days.

(21) Appl. No.: 11/984,214

(22) Filed: Nov. 14, 2007

(65) Prior Publication Data

US 2008/0196439 A1 Aug. 21, 2008

(30) Foreign Application Priority Data

Feb. 21, 2007 (KR) ..... 10-2007-0017465
Jun. 26, 2007 (KR) ..... 10-2007-0063159

(51) Int. Cl.
*A47B 96/04* (2006.01)

(52) U.S. Cl. ..... 312/402; 312/405.1

(58) Field of Classification Search ..... 312/401, 312/402, 405, 405.1, 321.5, 351
See application file for complete search history.

(56) References Cited

U.S. PATENT DOCUMENTS 2,705,565 A * 4/1955 McKirgan ..... 211/90.04
2,944,410 A * 7/1960 Mann et al. ..... 62/186
4,840,279 A * 6/1989 Cobb et al. ..... 211/88.01
5,598,932 A * 2/1997 Weidert ..... 211/41.1
5,820,239 A * 10/1998 Christenson et al. .... 312/334.23
6,742,855 B2 * 6/2004 Whitaker et al. ..... 312/405.1
6,799,818 B2 * 10/2004 Ahmed et al. ..... 312/405.1
6,908,163 B1 * 6/2005 Hebeler et al. ..... 312/405.1
D513,270 S * 12/2005 Seok et al. ..... D15/89
6,971,730 B2 * 12/2005 Koons ..... 312/404
6,997,526 B2 * 2/2006 Leimkuehler et al. ..... 312/321.5
7,111,914 B2 * 9/2006 Avendano ..... 312/405.1
7,472,974 B2 * 1/2009 Czach et al. ..... 312/405.1
7,552,983 B2 * 6/2009 Shin ..... 312/405.1
2004/0100168 A1 * 5/2004 Choi ..... 312/296
2004/0178711 A1 * 9/2004 Avendano ..... 312/405.1
2004/0217680 A1 * 11/2004 Lee ..... 312/405.1
2005/0073227 A1 * 4/2005 Shin ..... 312/404
2006/0061247 A1 * 3/2006 Lee et al. ..... 312/404
2007/0273256 A1 * 11/2007 Martin et al. ..... 312/223.6

FOREIGN PATENT DOCUMENTS

DE 19646206 * 5/1998
JP 11301717 * 11/1999
KR 10-2005-0117536 12/2005

* cited by examiner

*Primary Examiner* — Darnell Jayne
*Assistant Examiner* — Matthew Ing
(74) *Attorney, Agent, or Firm* — Staas & Halsey LLP

(57) ABSTRACT

A refrigerator includes a refrigerator main body having a storage space; a door installed at the refrigerator main body to open and close the storage space; and a receiving device including a storage basket which is accommodated in the storage space and has a storage chamber to store a product and an auxiliary basket which is installed to be spaced from a bottom of the storage basket and has an insertion groove to receive a thin product such that the thin product is stored in the storage chamber in a standing state. According to the refrigerator, since a product having a large width and a small thickness can be stored in a standing state, it is possible to conveniently store a product such as a pizza box and efficiently use a storage space.

12 Claims, 10 Drawing Sheets

REFRIGERATOR WITH AUXILIARY BASKET

CROSS-REFERENCE TO RELATED APPLICATIONS

This application claims the benefit of Korean Patent Application No. 2007-0017465, filed on Feb. 21, 2007 and No. 2007-0063159, filed on Jun. 26, 2007 in the Korean Intellectual Property Office, the disclosure of which is incorporated herein by reference.

BACKGROUND

1. Field

The present invention relates to a refrigerator, and more particularly to a refrigerator capable of efficiently storing a product, such as a pizza box, which has a large width and a small thickness.

2. Description of the Related Art

A refrigerator includes a cooling chamber to store various food products and beverages to cool them, a freezing chamber to store frozen food products, such as meat, fish and ice cream to freeze them, and a cool air generating device to supply cool air to the cooling chamber and the freezing chamber. A shelf or a storage basket is installed in the cooling chamber and the freezing chamber to support various chilled or frozen food products put thereon. The cool air generating device includes an evaporator to cool the surrounding air and a fan to forcibly blow the cooled air. The cool air generating device supplies cool air to the freezing chamber and the cooling chamber to cool the freezing chamber and the cooling chamber.

Generally, refrigerators for home use may be classified into a general type refrigerator, a side-by-side type refrigerator, a hybrid refrigerator, etc. according to the arrangement of the cooling chamber and the freezing chamber, and a door installation structure. One of the most commonly used general type refrigerator includes a freezing chamber disposed at an upper portion and a cooling chamber disposed under the freezing chamber. The general type refrigerator further includes a freezing chamber door and a cooling chamber door which are respectively arranged at upper and lower sides of the refrigerator.

The side-by-side type refrigerator includes a freezing chamber and a cooling chamber respectively disposed in left and right compartments of the refrigerator. The side-by-side type refrigerator further includes a freezing chamber door and a cooling chamber door disposed on left and right sides of the refrigerator. An ice maker to make ice may be disposed in the freezing chamber, and a dispenser may be disposed in the freezing chamber door to discharge the ice made in the ice maker such that the ice can be easily taken outside the freezing chamber door. The side-by-side type refrigerator is appropriate for a large-capacity refrigerator including a large-capacity freezing chamber and a large-capacity cooling chamber.

The hybrid refrigerator includes a freezing chamber disposed at a lower portion and a cooling chamber disposed on the freezing chamber. The freezing chamber is opened or closed by a drawer-type door. The cooling chamber is opened or closed by a pair of cooling chamber doors arranged on left and right sides of the refrigerator. In the hybrid refrigerator, the ice maker is disposed in the cooling chamber and the dispenser is disposed in the cooling chamber door. Accordingly, the hybrid refrigerator has an advantage in that water supplied into the ice maker is not frozen compared to the side-by-side type refrigerator including the ice maker disposed in the freezing chamber.

Korean Patent Laid-open Publication No. 2005-117536 discloses an example of the hybrid refrigerator. The hybrid refrigerator disclosed in the Publication includes a cooling chamber disposed at an upper portion of a refrigerator main body, and a freezing chamber disposed under the cooling chamber. Further, the cooling chamber is opened or closed by a pair of cooling chamber doors, and the freezing chamber is opened or closed by a drawer-type door.

However, the conventional refrigerator does not include a separate space capable of storing a product, such as a pizza box, having a large width and a small thickness in the freezing chamber. Thus, conventionally, the product such as a pizza box is stored on the bottom of the freezing chamber. In this case, however, if another product is put on the product such as a pizza box, it causes inconvenience when the product such as a pizza box is taken out again. Further, if another product is stored to be separated from the product such as a pizza box, a space above the product such as a pizza box cannot be used, thereby causing a problem such as a reduction in space efficiency.

As described above, if there is no space for a product with a large width and a small thickness, it is inconvenient to store such a product. Even though the product does not have a large volume, it occupies a large space in the storage chamber.

SUMMARY

The present embodiment has been made in order to solve the above problems. It is an aspect of the embodiment to provide a refrigerator capable of efficiently and easily storing a product, such as a pizza box, having a large width and a small thickness.

Further, it is another aspect of the embodiment to provide a refrigerator capable of efficiently using a space of a receiving device to receive a product.

Additional aspects and/or advantages will be set forth in part in the description which follows and, in part, will be apparent from the description, or may be learned by practice of the invention.

The foregoing and/or other aspects are achieved by providing a refrigerator including: a refrigerator main body having a storage space; a door installed at the refrigerator main body to open and close the storage space; and a receiving device including a storage basket which is accommodated in the storage space and has a storage chamber to store a product, and an auxiliary basket which is installed to be spaced from a bottom of the storage basket and has an insertion groove defined therein to receive a thin product such that the thin product is stored in the storage chamber in a standing state.

An opening/closing member is installed at the auxiliary basket to open and close the insertion groove.

The opening/closing member may be hinge-coupled to the auxiliary basket.

The refrigerator according to the present invention further includes a fixing part which fixes the opening/closing member in a state in which the opening/closing member closes the insertion groove. Further, the fixing part may include a fixing hole defined within one of the auxiliary basket and the opening/closing member, and a fixing protrusion disposed on the other one of the auxiliary basket and the opening/closing member to be pressed and inserted into the fixing hole.

The auxiliary basket may be detachably installed in the storage basket.

The refrigerator may further include split brackets detachably installed in the storage basket to support the auxiliary basket. The auxiliary basket may be rotatably coupled to the split brackets to be inclined at a specified angle.

At least one coupling member may be protrudingly formed on one of the storage basket and the split brackets, and at least one coupling groove may be formed on the other of the storage basket and the split brackets to be coupled with the coupling member.

A receiving groove may be formed on the bottom of the storage basket to receive a lower portion of the thin product which stands in the storage basket.

The auxiliary basket has a storage space which stores a product.

The receiving device may be installed at the door.

The auxiliary basket is detachably installed at the door.

The foregoing and/or other aspects are achieved by providing a refrigerator, including: a main body including at least one storage chamber; a cool air generating device generating cool air in the main body; a storage basket accommodated within a portion of the storage chamber and including a receiving groove to receive a bottom portion of a product; and an auxiliary basket disposed at an upper portion of the storage basket and including an insertion groove to receive a top portion of the product.

The auxiliary basket may be detachably coupled to the storage basket. The refrigerator may include a split bracket detachably coupled to the storage basket and the auxiliary basket. The split bracket may include at least one groove and at least one hook member, and the storage basket may include at least one fixing member having an inclined surface, the fixing member being received into the at least one groove at the inclined surface, the hook member affixing to a lower portion of the fixing member and attaching the split bracket to the storage basket.

The refrigerator may include a door coupled to the storage basket, and the auxiliary basket may be detachably coupled to the door. The refrigerator may include a split bracket detachably coupled to the door and the auxiliary basket. The split bracket may include at least one groove and at least one hook member, and the storage basket may include at least one fixing member having an inclined surface, the fixing member being received into the at least one groove at the inclined surface, the hook member affixing to a lower portion of the fixing member and attaching the split bracket to the door.

The refrigerator may include an opening/closing member coupled to the auxiliary basket opening/closing the insertion groove such that when the opening/closing member is in a closed state, a product-holding surface is created.

BRIEF DESCRIPTION OF THE DRAWINGS

These and/or other aspects and advantages of the embodiments will become apparent and more readily appreciated from the following description of the embodiments, taken in conjunction with the accompanying drawings, of which.

DETAILED DESCRIPTION OF THE EMBODIMENTS

Figure 1:
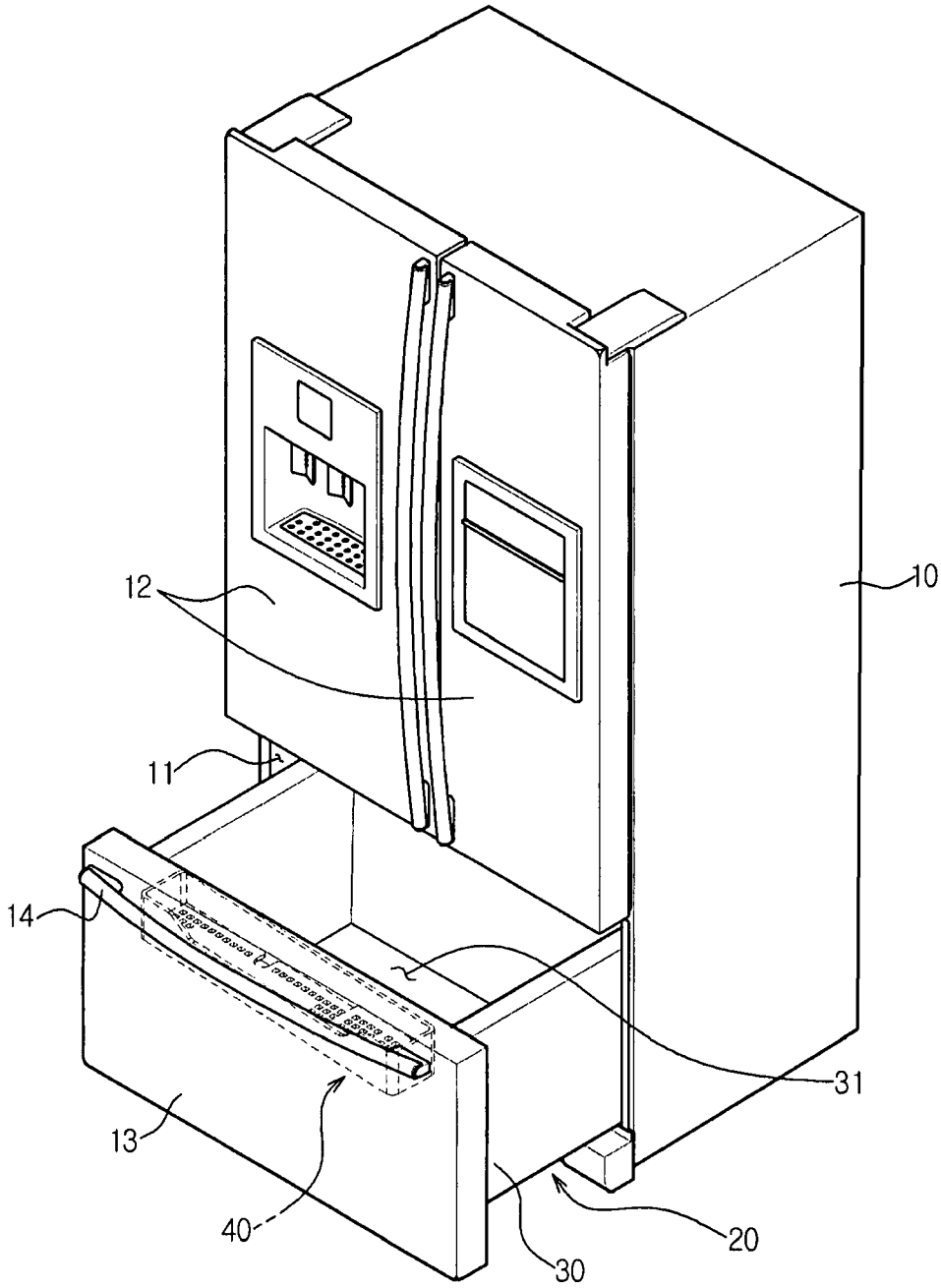
FIG. 1 is a perspective view schematically showing a refrigerator according to an embodiment.

Reference will now be made in detail to the embodiments, examples of which are illustrated in the accompanying drawings, wherein like reference numerals refer to like elements throughout. The embodiments are described below to explain the present invention by referring to the figures.

Hereinafter, a refrigerator according to embodiments will be described in detail with reference to the accompanying drawings.

As shown in FIG. 1, the refrigerator according to a first embodiment includes a refrigerator main body 10 having storage spaces, such as a cooling chamber (not shown) and a freezing chamber 11 which store products, a pair of hinged doors 12 which opens and closes the cooling chamber disposed at an upper portion of the refrigerator main body 10, a drawer type door 13 which opens and closes the freezing chamber 11 disposed at a lower portion of the refrigerator main body 10, and a receiving device 20 installed at the drawer type door 13. In addition, a cool air generator (not shown) which generates cool air and various electric and electronic devices (not shown) are installed in the refrigerator main body 10.

Since other configurations except the receiving device 20 are the same as the conventional configurations, the detailed description thereof is omitted.

Figure 2:
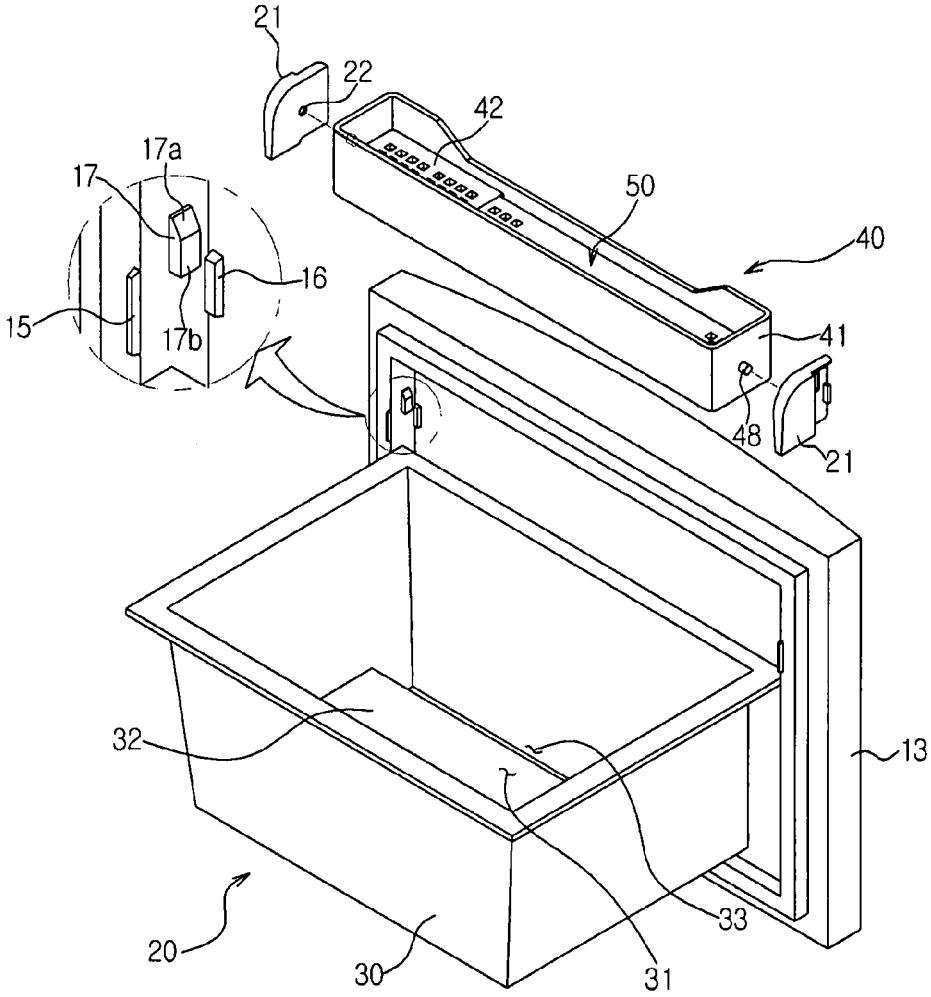
FIG. 2 is an exploded perspective view schematically showing a receiving device of the refrigerator according to the embodiment.
Figure 3:
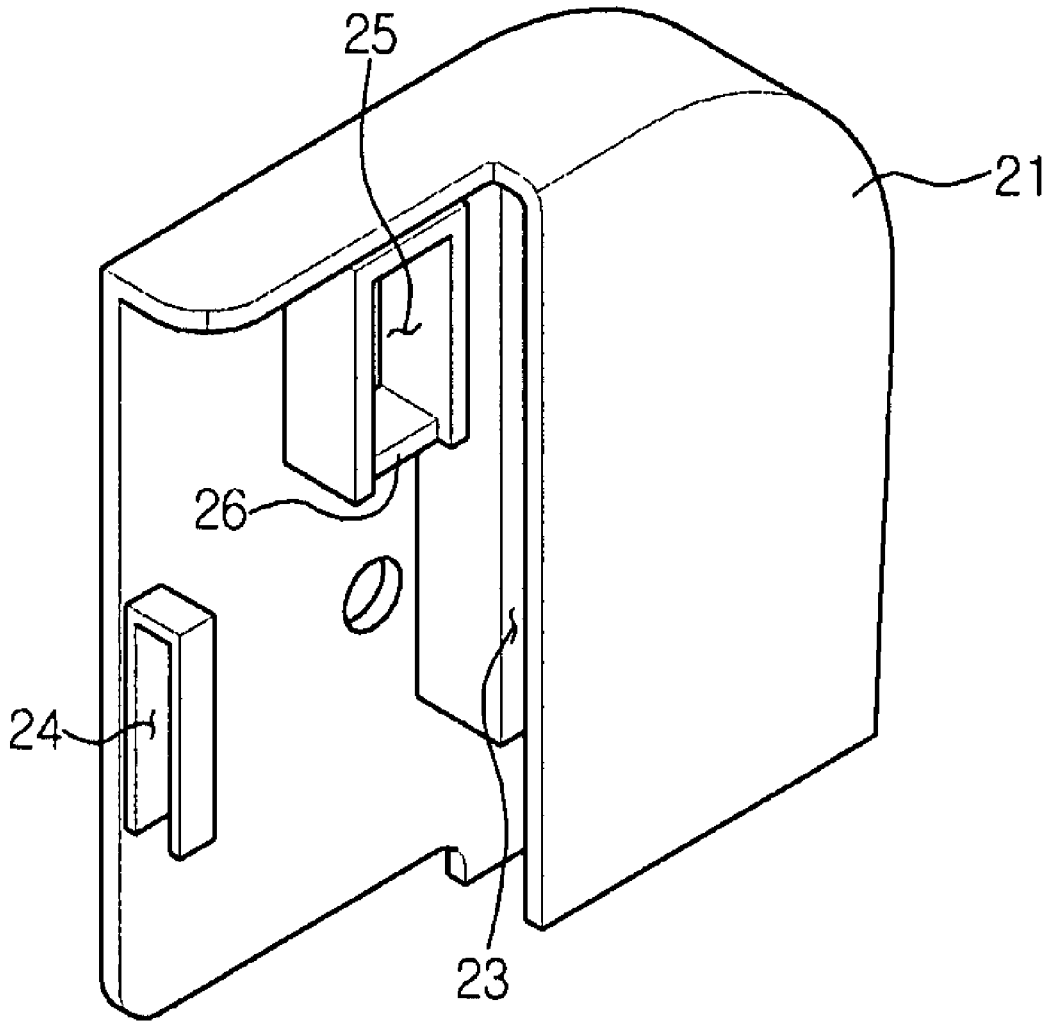
FIG. 3 is a perspective view schematically showing split brackets of the receiving device shown in FIG. 2.

As shown in FIGS. 1 and 2, the receiving device 20 is coupled to the drawer type door 13 which is slidably installed at a lower portion of the refrigerator main body 10 to be received in the freezing chamber 11. The drawer type door 13 has a handle 14. The receiving device 20 includes a storage basket 30 having a storage chamber 31 and an auxiliary basket 40 disposed at an upper portion of the storage basket 30.

A receiving groove 33 is formed on a bottom 32 of the storage basket 30 to receive a lower portion of a product, such as a pizza box B (see FIG. 7), which has a large width and a small thickness. The receiving groove 33 is formed at a front portion of the storage basket 30 close to the drawer type door 13.

The auxiliary basket 40 supports a product stood in the storage basket 30 so as to stand and store a product, such as the pizza box B, which has a large width and a small thickness in the storage basket 30. The auxiliary basket 40 is installed on a pair of split brackets 21 disposed at opposite inner sides of the drawer type door 13 to be inclined at a specified angle (e.g., 30 degrees) such that the auxiliary basket 40 is positioned at an upper portion of the storage basket 30. Support shafts 48 are protrudingly formed at opposite end portions on the left and right sides of the auxiliary basket 40. An insertion hole 22 is formed on each of the split brackets 21 such that each of the support shafts 48 is rotatably inserted into the insertion hole 22.

The split brackets 21 are detachably coupled to opposite side portions of the drawer type door 13. First coupling members 15, second coupling members 16 and fixing members 17 are respectively protrudingly formed at the opposite sides of the drawer type door 13, and first coupling grooves 23, second coupling grooves 24 and fixing grooves 25 are respectively formed on the split brackets 21 such that the split brackets 21 can be detachably coupled to the drawer type door 13. The first coupling members 15 are inserted into the first coupling grooves 23. The second coupling members 16 are inserted into the second coupling grooves 24. The fixing members 17 are inserted into the fixing grooves 25. Further, an inclined surface 17*a*, which is inclined from top to bottom, is provided on each of the fixing members 17. A hook member 26 is provided at a lower portion of each of the fixing grooves 25 to prevent the fixing members 17 from being separated from the fixing grooves 25 when the fixing members 17 are inserted into the fixing grooves 25.

The split brackets 21 are coupled to the drawer type door 13 from top to bottom and are separated from the drawer type door 13 from bottom to top. When the split brackets 21 are coupled to the drawer type door 13 from top to bottom, the first coupling members 15 are slid into the first coupling grooves 23, the second coupling members 16 are slid into the second coupling grooves 24, and the surface of the fixing members 17 are slid into the fixing grooves 25. Further, when the surface of the fixing members 17 are inserted into the fixing grooves 25, the hook member 26 becomes in close contact with a lower end portion of the fixing member 17. Accordingly, since the lower end portion of the fixing member 17 is hooked by the hook member 26, the fixing member 17 cannot be easily separated from each fixing groove 25. When a user pulls the split brackets 21 upward, the fixing members 17 can be separated from the fixing grooves 25.

As described above, since both the auxiliary basket 40 and a pair of the split brackets 21 can be separated from the drawer type door 13, it is possible to enlarge a storage space of the storage basket 30 by separating the auxiliary basket 40 from the drawer type door 13 according to a user's circumstances.

In the coupling structure of the drawer type door 13 and the split brackets 21 capable of being separated from the drawer type door 13, the first and the second coupling members 15 and 16 and the fixing members 17 may be disposed on the split brackets 21, and the first and the second coupling grooves 23 and 24 and the fixing grooves 25 may be disposed on the drawer type door 13.

Figure 5:
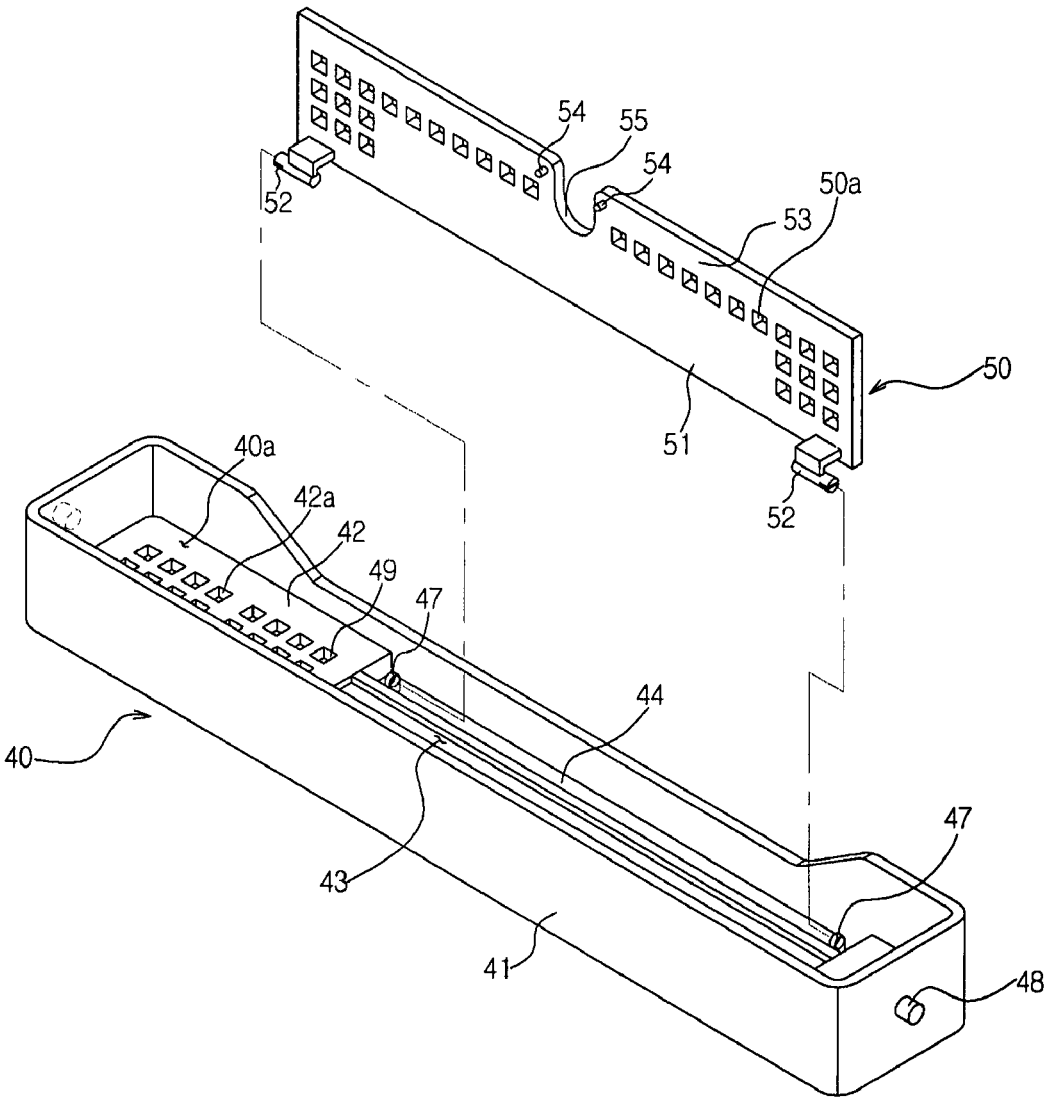
FIG. 5 is an exploded perspective view schematically showing an auxiliary basket of the receiving device shown in FIG. 2.

As shown in FIG. 5, the auxiliary basket 40 includes a frame 41 having a rectangular storage space 40*a* therein, and an opening/closing member 50 of a rectangular plate shape which is installed in the storage space 40*a* and able to be rotated by a specified angle (e.g., 90 degrees).

An upper bottom 42, which includes an insertion groove 43 that is defined by an opening in the upper bottom 42 having a specified size, and a lower bottom 44 disposed under the upper bottom 42 to have a height difference with respect to the upper bottom 42 are provided in the frame 41. Through holes 42*a* are formed on the upper bottom 42 to allow the flow of cool air. A pair of shaft supporting members 47 is installed on the lower bottom 44. The opening/closing member 50 is installed at the shaft supporting members 47 to be able to be rotated by a specified angle (e.g., 90 degrees). A pair of hinge shafts 52 is disposed at one end portion 51 of the opening/closing member 50 supported by the shaft supporting members 47, and the hinge shafts 52 are rotatably coupled to the shaft supporting members 47. A handle portion 55 is disposed at the other end portion 53 of the opening/closing member 50 to facilitate the user's operation of the opening/closing member 50.

Figure 6A:
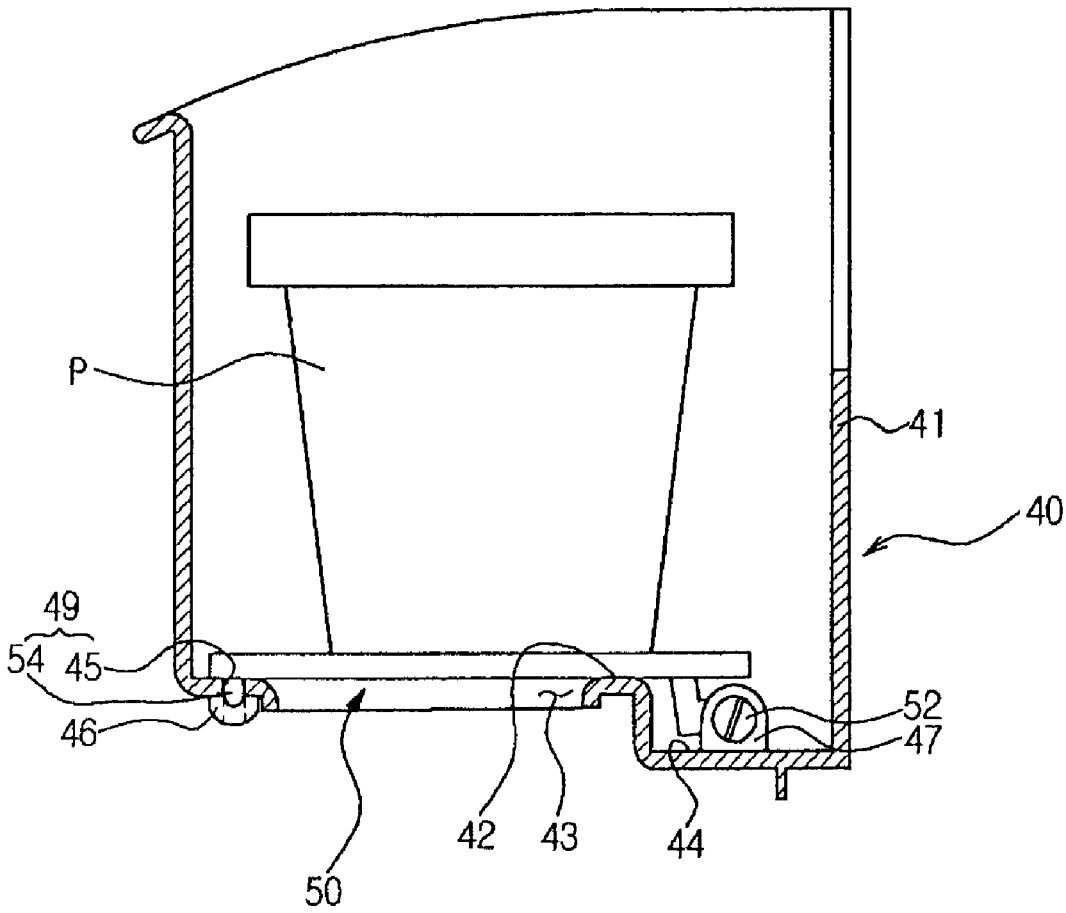
FIGS. 6A and 6B are side cross-sectional views for explaining a function of the auxiliary basket shown in FIG. 5.

As shown in FIG. 6A, a fixing part 49 is disposed on the auxiliary basket 40 to fix the position of the opening/closing member 50 in a state in which the opening/closing member 50 closes the insertion groove 43. The fixing part 49 includes a pair of fixing holes 45 disposed on the upper bottom 42 of the frame 41 and a pair of fixing protrusions 54 disposed on the other end portion 53 of the opening/closing member 50 to be pressed and inserted into the fixing holes 45, respectively. As the fixing protrusions 54 of the opening/closing member 50 are pressed and inserted into the fixing holes 45, the opening/closing member 50 is fixed to cover the insertion groove 43. Since the upper bottom 42 of the frame 41 and the opening/closing member 50 form the bottom of the storage space 40*a*, a small-sized product P can be stored in the storage space 40*a*. Also, through holes 50*a* are formed on the opening/closing member 50 to allow the flow of cool air.

Boss portions 46 are protrudingly formed at a lower portion of the frame 41 to correspond to the fixing holes 45. The fixing holes 45 are formed in the center of the boss portions 46 to receive the fixing protrusions 54 of the opening/closing member 50. Accordingly, the opening/closing member 50 can be stably fixed to the frame 41.

Further, the boss portions 46 have a function of reinforcing the upper bottom 42 of the frame 41. When the fixing protrusions 54 are inserted into or separated from the fixing holes 45, an impact is applied to the upper bottom 42 of the frame 41. In this case, since a portion around the fixing holes 45 is thicker than a portion not surrounding the fixing holes 45 due to the presence of the boss portions 46, the upper bottom 42 is not easily deformed or damaged due to an impact.

Figure 6B:
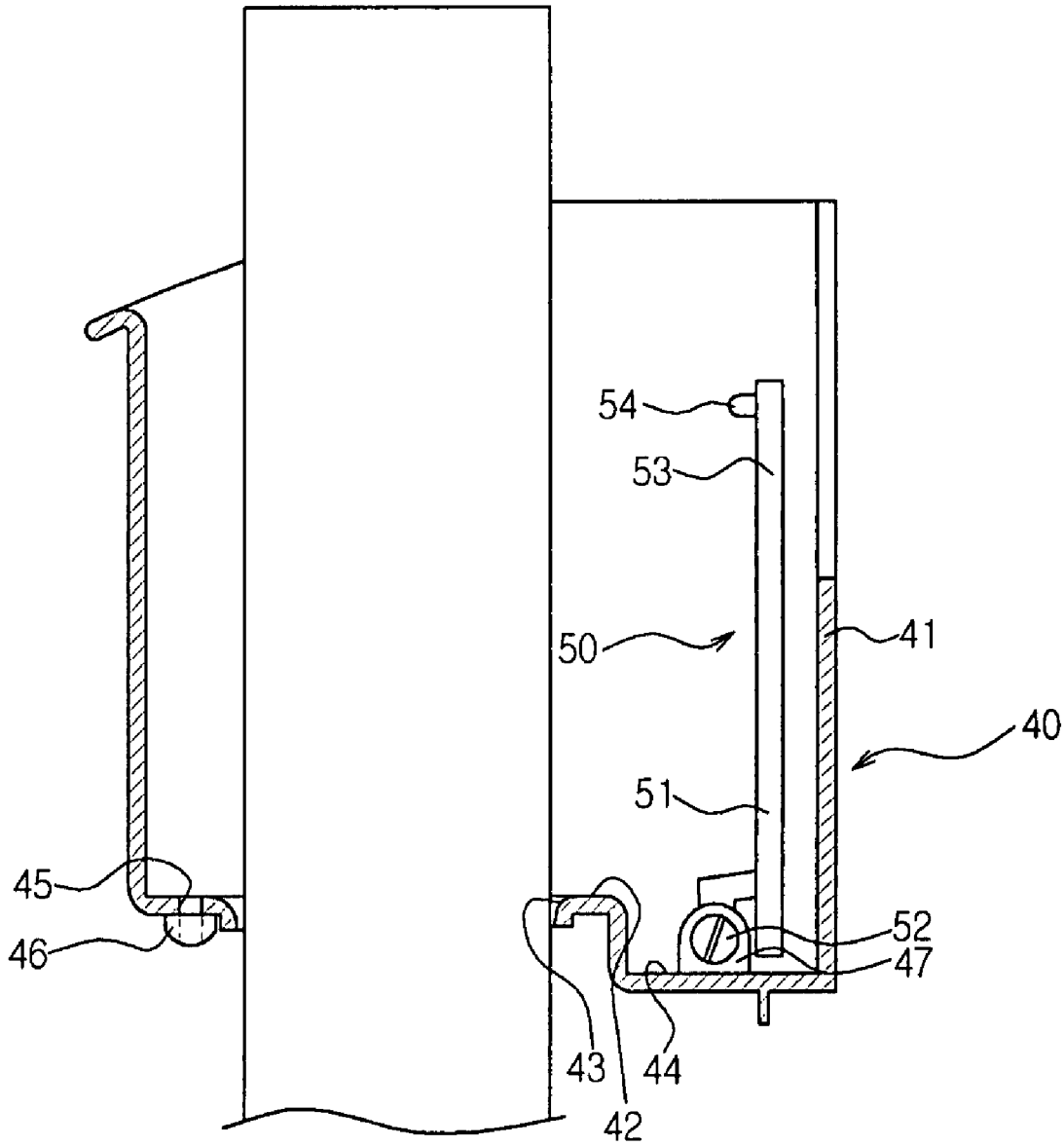

In order to store a thin product, such as the pizza box B, in the storage basket 30, as shown in FIG. 6B, the product P is removed from the storage space 40*a*, and the other end portion 53 of the opening/closing member 50 is pulled while holding the handle portion 55 of the opening/closing member 50, thereby opening the insertion groove 43.

Hereinafter, a function of the receiving device 20 of the refrigerator according to the embodiment will be described in detail with reference to the accompanying drawings.

Figure 7:
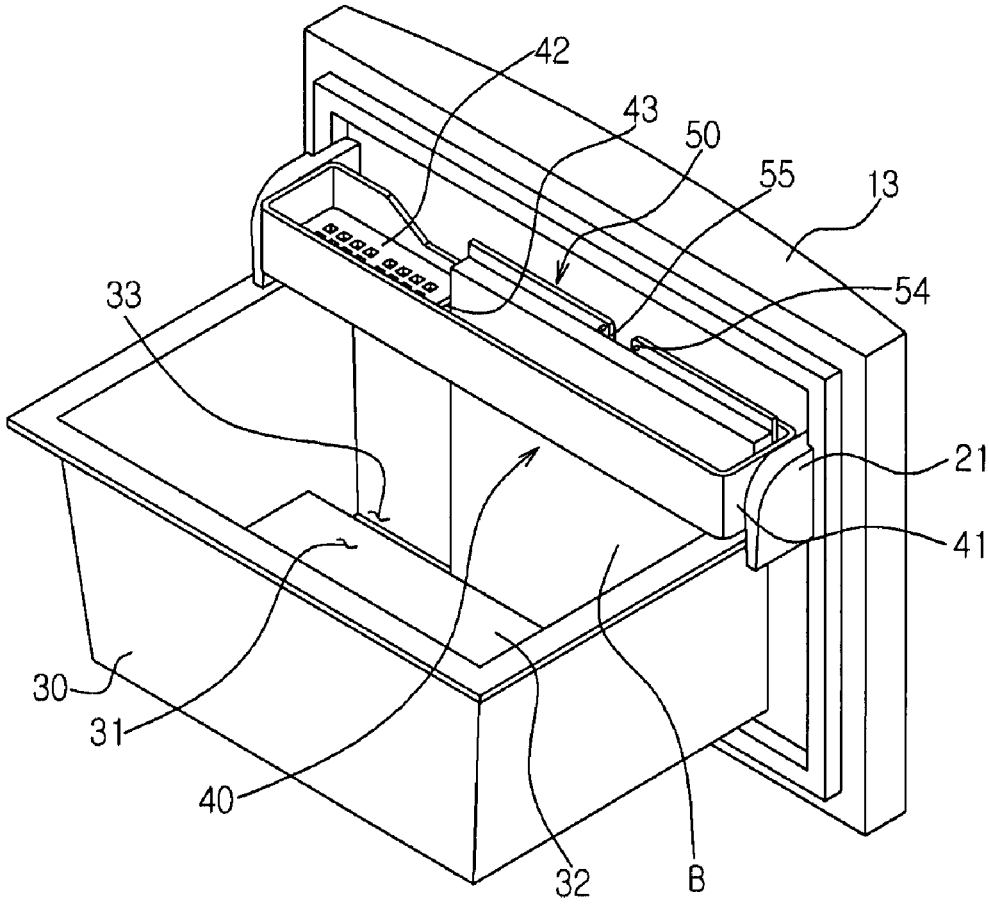
FIGS. 7 and 8 are a perspective view and a side cross-sectional view, respectively, in which a thin product is received in the receiving device shown in FIG. 2.
Figure 8:
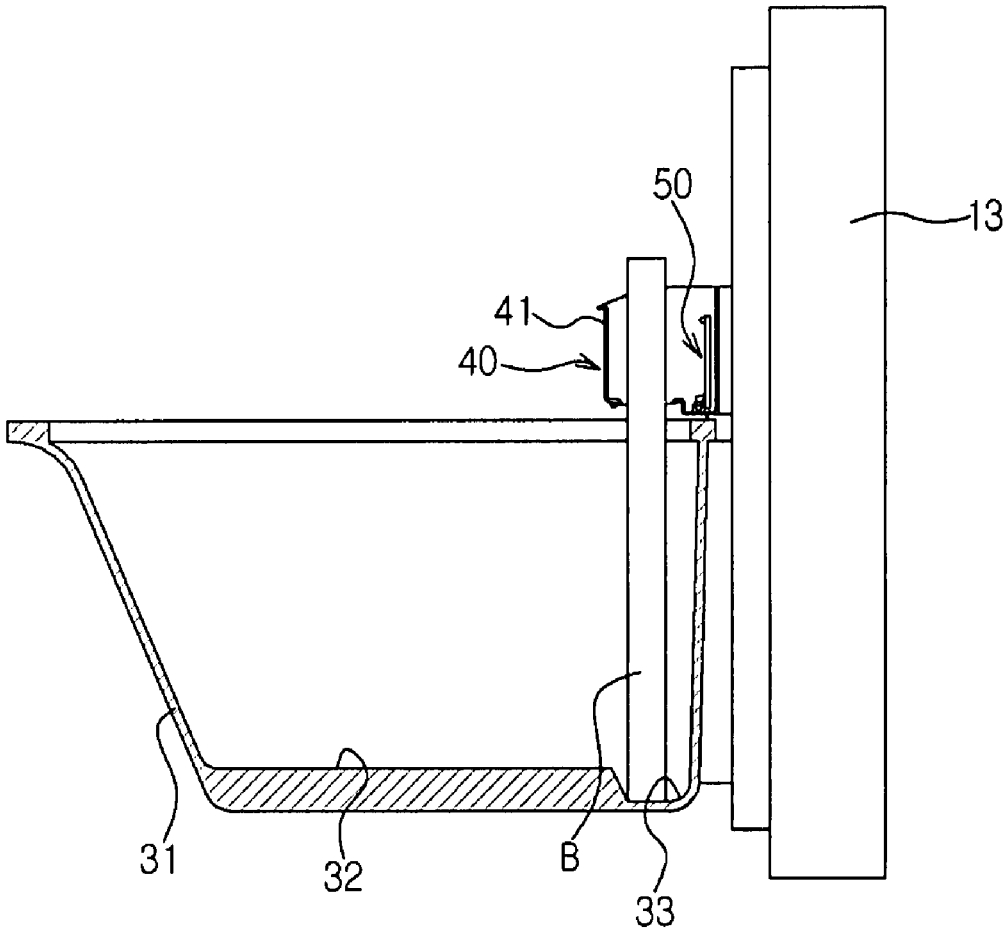

When the pizza box B having a large width and a small thickness is stored in the storage basket 30, the opening/closing member 50 is pulled while holding the handle portion 55 disposed on the opening/closing member 50 of the auxiliary basket 40, thereby opening the insertion groove 43 of the auxiliary basket 40. Then, as shown in FIGS. 7 and 8, the opening/closing member 50 of the auxiliary basket 40 is completely rotated and, then the pizza box B in a standing state is inserted into the insertion groove 43.

When the pizza box B is inserted into the insertion groove 43, the pizza box B can be easily inserted into the insertion groove 43 by leaning the auxiliary basket 40 backward. The pizza box B inserted into the insertion groove 43 of the auxiliary basket 40 has a lower portion which is received in the receiving groove 33 of the storage basket 30 and an upper portion which is supported by the auxiliary basket 40. Accordingly, the pizza box B is stored in the storage basket 30 in a standing state. Even though the storage basket 30 moves with the drawer type door 13, the pizza box B does not fall down.

As described above, since the pizza box B having a large width and a small thickness can be stored in a standing state using the auxiliary basket 40, it is possible to efficiently use a space of the storage chamber 31 of the storage basket 30 compared to a conventional refrigerator in which the pizza box B is stored in the storage basket 30 while the box B is laid down.

Further, after the pizza box B is taken out, the opening/closing member 50 of the auxiliary basket 40 is returned to its original position and fixed to the upper bottom 42. Accordingly, a small-sized product P (see FIG. 6A) can be stored in the auxiliary basket 40.

Meanwhile, since the auxiliary basket 40 can be separated from the drawer type door 13, it is possible to extensively use the storage chamber 31 of the storage basket 30 by separating the auxiliary basket 40 from the drawer type door 13.

Figure 4:
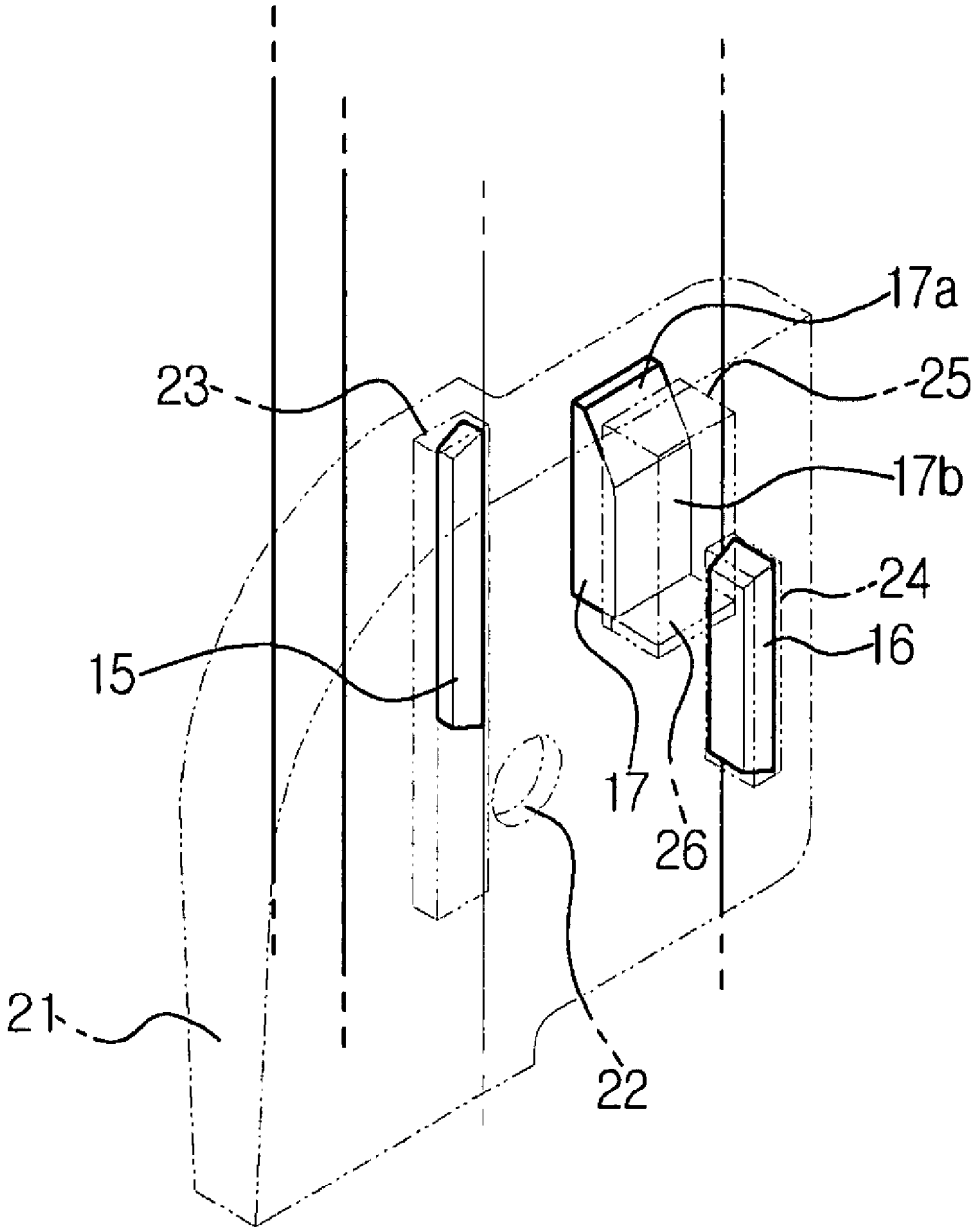
FIG. 4 illustrates a perspective view showing a state in which the split brackets shown in FIG. 3 are coupled to a door.
Figure 9:
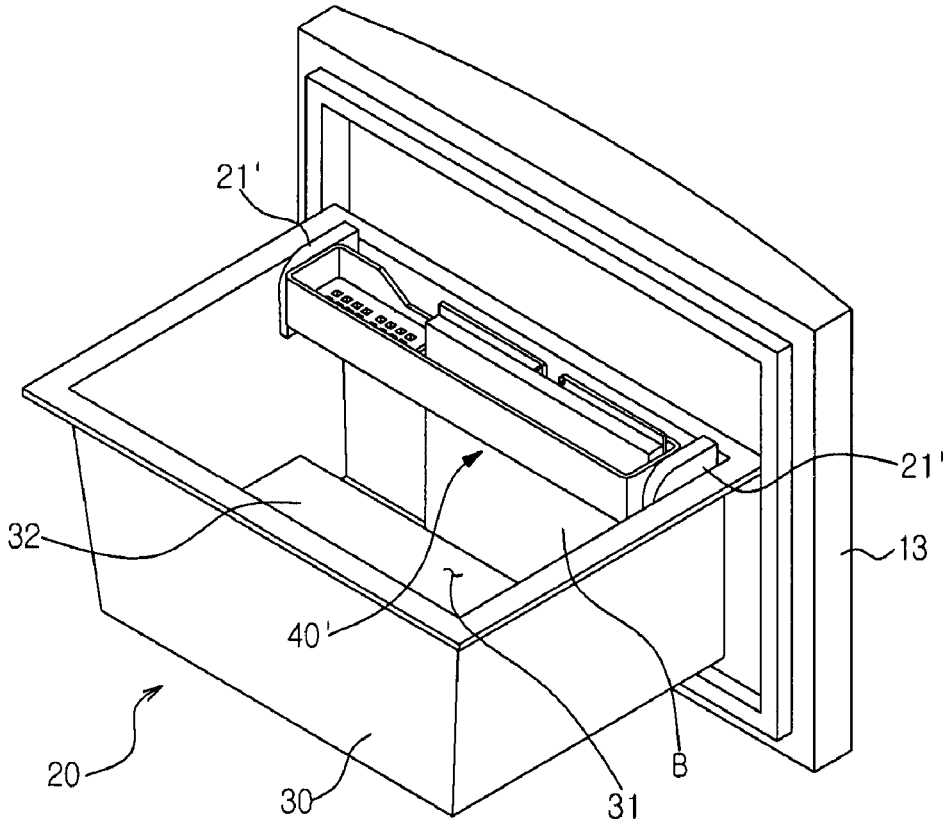
FIG. 9 is a perspective view schematically showing another type of receiving device.

Meanwhile, FIG. 9 shows an example in which an auxiliary basket 40' is detachably installed in the storage basket 30. In this case, a pair of split brackets 21' is detachably coupled to the storage basket 30 instead of being detachably coupled to the drawer door 13 itself. The coupling grooves 24 (see FIG. 4) and the fixing grooves 25 (see FIG. 4) may be disposed on the split brackets 21', and the coupling members 16 and the fixing members 17 which are respectively inserted into the coupling grooves 24 (see FIG. 4) and the fixing grooves 25 (see FIG. 4) may be disposed at the opposite sides of the storage basket 30 such that the split brackets 21' are detachably coupled to the storage basket 30 in the same manner as in the above embodiment. The coupling structure capable of detachably coupling the split brackets 21' to the storage basket 30 may be formed using various well-known methods.

Meanwhile, although the receiving device 20 according to the present embodiments is accommodated in the freezing chamber 11, the receiving device 20 according to the present embodiments may be installed in the cooling chamber.

As described above, according to the present embodiments, a product having a large width and a small thickness can be stored in a standing state, thereby conveniently storing a product such as a pizza box.

Further, according to the present embodiments, it is possible to efficiently use a space of the receiving device for receiving a product.

Although embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a refrigerator main body having an upper refrigerator storage space and a lower freezing storage space;

a drawer-type freezer door installed at the lower freezing storage space of the refrigerator main body to open and close the freezing storage space, the freezer door including a front side to which a handle is attached and a rear side;

a main storage unit coupled to the drawer-type freezer door, the main storage unit moveable integrally with the freezer door; and an auxiliary storage unit coupled to the drawer-type freezer door and located above the main storage unit, the auxiliary storage unit pivotally mounted to the rear side of the freezer door such that when the drawer-type freezer door is slidably moved to an open position; a first bracket having a first side detachably coupled to the door and a second side rotatably coupled to a first side of the auxiliary storage unit, and a second bracket having a first side detachably coupled to the door and a second side rotatably coupled to a second side of the auxiliary storage unit, wherein the first bracket and the second bracket are constructed as two separate pieces, the door has at least first and second fixing members, the first side of the first and second brackets has at least a first fixing groove adapted to receive the first fixing member of the door, and the second fixing member extends approximately perpendicular to the first fixing member.

2. The refrigerator according to claim 1, wherein the auxiliary basket is rotatably coupled to the first and second brackets to be inclined at a specified angle.

3. The refrigerator of claim 1, wherein the first side of the first and second brackets has a second fixing groove adapted to receive the second fixing member of the door.

4. The refrigerator according to claim 1, wherein the upper opening of the auxiliary storage unit is partially hidden from view from a perspective of a user standing directly in front of the refrigerator and the auxiliary storage unit is accessible by the user reaching over a top of the freezer door and tilting the auxiliary storage unit in a rearward direction to enable full access to the upper opening of the auxiliary storage unit.

5. The refrigerator according to claim 1, wherein the auxiliary storage unit includes a bottom wall to store items.

6. The refrigerator according to claim 5, wherein an opening/closing member is installed at a bottom of the auxiliary storage unit to function as a bottom wall thereof when the opening/closing member is in a closed position, when the opening/closed member is moved to an open position, the bottom of the auxiliary storage unit defines an insertion groove to receive a thin product such that the thin product is stored in a standing state.

7. The refrigerator according to claim 6, further comprising a fixing part which fixes the opening/closing member in a state in which the opening/closing member is in the closed position.

8. The refrigerator according to claim 6, wherein a receiving groove is formed on the bottom of the main storage unit to receive a lower portion of the thin product which is received in the auxiliary storage unit.

9. The refrigerator according to claim 8, wherein the thin product supported by the main storage unit and the auxiliary storage unit comprises a pizza box.

10. A refrigerator, comprising:

a body partitioned by a horizontal partition wall to have an upper cooling chamber and a lower freezing chamber;

a cool air generating device generating cool air in the main body;

a storage basket accommodated within a portion of the freezing chamber and including a receiving groove to receive a bottom portion of a pizza box product in a standing state, the storage basket being moveable integrally with a freezer door;

an auxiliary basket disposed above the storage basket and including an insertion groove to receive a top portion of the pizza box product in the standing state; and a bracket having a first side detachably coupled to the door and a second side rotatably coupled to the auxiliary storage unit, wherein the door has at least first and second fixing members, the first side of the bracket has at least one fixing groove adapted to receive the first fixing member of the door, the second fixing member extends approximately perpendicular to the first fixing member, and the auxiliary basket is coupled to a rear side of the freezer door and integrally movable with the freezer door.

11. The refrigerator according to claim 10, further comprising an opening/closing member coupled to the auxiliary basket opening/closing the insertion groove such that when the opening/closing member is in a closed state, a product-holding surface is created.

12. The refrigerator according to claim 10, wherein the bracket includes a hook member, the first fixing member has an inclined surface, the first fixing member being received into the first groove at the inclined surface, and the hook member affixing to a lower portion of the first fixing member and attaching the bracket to the door.

* * * * *